United States Patent [19]

Anderson et al.

[11] 4,433,622

[45] Feb. 28, 1984

[54] PRINTING STATION FOR AXIAL LEAD HANDLING SYSTEM

[75] Inventors: Gary W. Anderson, Transfer; Dennis G. Stake, Greenville, both of Pa.

[73] Assignee: GTI Corporation, San Diego, Calif.

[21] Appl. No.: 430,664

[22] Filed: Sep. 30, 1982

[51] Int. Cl.[3] ..... B41F 17/22

[52] U.S. Cl. ..... 101/40

[58] Field of Search ..... 101/40, 38 R, 38 A, 101/39, 35; 206/329, 330; 198/654, 655, 656, 476, 479

[56] References Cited

U.S. PATENT DOCUMENTS

| | | | |
|---|---|---|---|
| 2,994,263 | 8/1961 | Rus | 101/40 X |
| 3,048,268 | 8/1962 | Rocchi et al. | 206/329 |
| 3,124,065 | 3/1964 | Bozek et al. | 101/40 X |
| 3,133,637 | 5/1964 | Siegler | 206/329 |
| 3,171,535 | 3/1965 | Harris | 206/329 X |
| 3,424,082 | 1/1969 | Gray, Jr. | 101/40 |
| 3,933,091 | 1/1976 | Von Saspe | 101/40 |

*Primary Examiner*—Clifford D. Crowder
*Attorney, Agent, or Firm*—Webb, Burden, Robinson & Webb

[57] ABSTRACT

An apparatus for printing upon the body of axial lead components arranged upon a component tape. The tape has equally spaced openings for receiving sprocket teeth and equally spaced component receiving openings. There are tabs associated with said component openings extending from the tape defining slots being narrowed at the end away from the tape. The slots may be spread by bending the tape. The apparatus comprises a horizontal base, a print station fixed above the base, a bending roll mounted on an axle substantially parallel to the horizontal base, an entry guide for slidably holding the loaded tape below the top of the bending roll and an exit guide for slidably holding the loaded tape below the top of the bending roll. The exit guide has a sprocket wheel for engaging the sprocket openings in the tape to pull it over the bending roll.

12 Claims, 10 Drawing Figures

PRINTING STATION FOR AXIAL LEAD HANDLING SYSTEM

DESCRIPTION

BACKGROUND OF THE INVENTION

In co-pending application Ser. No. 291,028, filed Aug. 7, 1981, now U.S. Pat. No. 4,418,815 a system for handling axial lead components is described. In that system the components are placed upon, carried by and removed from a special flexible tape. The tape has a plurality of sprocket receiving holes along it edges. It also has a plurality of component receiving holes spaced centrally along the tape. The component holes have tabs at each lateral end extending away from the tape. The tabs define a slot for receiving the leads of the components. The slot has a predefined width at the end away from the tape. The slot width increases toward the base of the tabs. In the above noted co-pending application, the system is described as useful for printing indicia upon components held by the tape. This application discloses a specific embodiment of an apparatus for offset printing upon components held by the component tape.

SUMMARY OF THE INVENTION

It is an object according to this invention to provide an apparatus for printing indicia upon axial lead components rotatably held by a component tape.

It is a further object to provide apparatus that can be adjusted to apply the proper amount of printing pressure to the components upon the tape without distorting the tape or the component leads.

It is a yet further object to provide an apparatus for printing upon an axial lead component in which the phasing between the component carrying tape and the offset print wheel is easily re-established after the drive to the tape has been temporarily disabled, for example, to set-up, adjust or clean the rotating offset print wheel.

It is an object to provide a unique dryer structure for drying the printed components while upon the component tape.

Briefly, according to this invention, there is provided an apparatus for printing upon the body of axial lead components arranged upon a component tape. The tape has equally spaced openings for receiving sprocket teeth and equally spaced component receiving openings. There are tabs associated with each component opening extending away from the tape and defining slots. The slots are narrowed at the end away from the tape. The slots may be spread by bending the tape. The apparatus for printing comprises a horizontal base; a printing station fixed above the base having at least one offset wheel rotating on a horizontal axis which wheel rolls over the surface of the component to be printed to transfer indicia thereto. A freely rotating bending roll is mounted on an axle substantial parallel to the horizontal base. The bending roll has a circumferential groove therein so that the loaded component tape can be drawn over the bending roll without interference between the components on the tape and the roll. The diameter of the bending roll is sufficiently small to bend the tape enough to spread the slots in the tabs to permit free turning of the leads within the slots and to present only one component at a time to the offset print wheel of the print station. The apparatus according to this invention further comprises an entry guide for slidably holding the loaded tape below the top of the bending roll and an exit guide for slidably holding the tape below the top of the bending roll and having a sprocket wheel for engaging the sprocket openings in the tape and pulling the tape over the bending roll. The printing station and the sprocket wheel on the exit guide are driven from a common drive enabling synchronism to be maintained between the advance of the tape and rotation of the offset wheel. A single position clutch is positioned between the common drive and the sprocket wheel for disengaging power to the sprocket wheel. However, because the clutch is a single position clutch, the phasing between the component tapes and the offset wheel is immediately re-established upon engagement of the clutch. According to a preferred embodiment of this invention, the indicia to be transferred to the components is placed at the trailing edge of the offset wheel so that the component is brought into rotation before indicia is transferred.

THE DRAWINGS

Further features and other objects and advantages of this invention will become clear from the following detailed description made with reference to the drawings.

FIG. 1 schematically illustrates the general arrangement of the axial lead handling system with printing station;

FIG. 2 schematically illustrates the offset printing apparatus;

DESCRIPTION OF THE PREFERRED EMBODIMENTS

Figure 1:
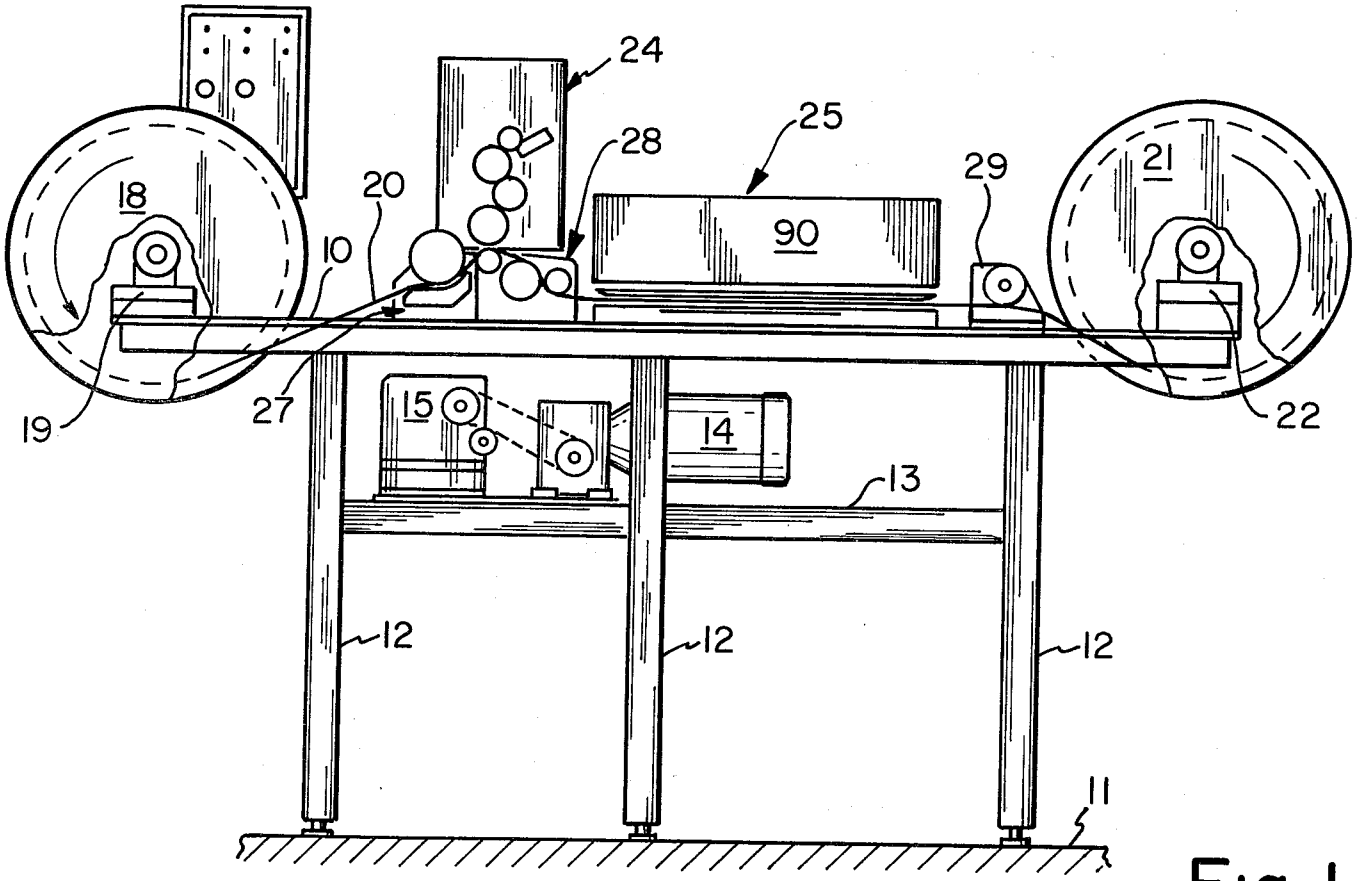

Referring now to FIG. 1, the print station according to this invention is supported upon a countertop 10 spaced above the floor 11 by legs 12. Positioned on a shelf 13 below the countertop is a motor 14 and gear reducer 15. The motor and gear reducer power the system.

At one end of the countertop (left in FIG. 1) is located a pay-off reel 18 pivotally mounted in bearing block 19. The loaded tape 20 carries the axial lead components to be printed upon. The component tape comprises flexible metal tape that has been especially perforated by die punching or molded plastic tape molded to have a plurality of sprocket receiving holes along its edges and a plurality of component receiving holes spaced centrally along the length of the tape. The component holes have tabs at each lateral end thereof that define a component lead receiving slot. The slot has a predefined width at the end away from the tab. The slot width is increased toward the base of the tabs. The predefined width of the slot at the end away from the tab is smaller than the diameter of the lead to be received in the slot. By flexing or bending the tape to spread the tabs the lead is provided a wider slot in which to rotate.

At the other end of the countertop (right end in FIG. 1) is a take-up reel 21 pivotally mounted in bearing block 22. Positioned between the pay-off and take-up reels are a print station 24 and a dryer 25.

The bearing block 19 for the pay-off reel is provided with a spring loaded slipping clutch that resists free rotation of the reel so that the tape will remain in tension as it is pulled off the reel. The spring compression should be adjustable to enable the adjustment of the drag provided by the clutch.

The bearing block for the take-up reel holds a drive shaft upon which a chain sprocket is mounted and output shaft upon which the reel is mounted. The take-up reel is chain driven, for example, indirectly from the motor 14. The drive shaft and output shaft drive are connected by a spring loaded slip clutch that is set to permit relative rotation of the shafts when the tape is held back by the tape drive assembly 28. This is necessary as the rate at which the reel takes up the tape is not only related to the rotation speed of the reel but to the amount of tape already laid upon the reel.

The tape is advanced and guided through an entry guide 27, a tape drive assembly 28 under the print station 24 and an exit guide 29. The print station 24 comprises a housing having a vertical front face in which a plurality of shafts for ink wheels are journaled. Each shaft is driven in synchronism by belts and sprockets (not shown) behind the front face. The offset print station 24 is typical of those currently available for printing electronic components and the details thereof form no part of this invention except to the extent that the tape carrying the components is driven in synchronism with the print station.

Figure 2:
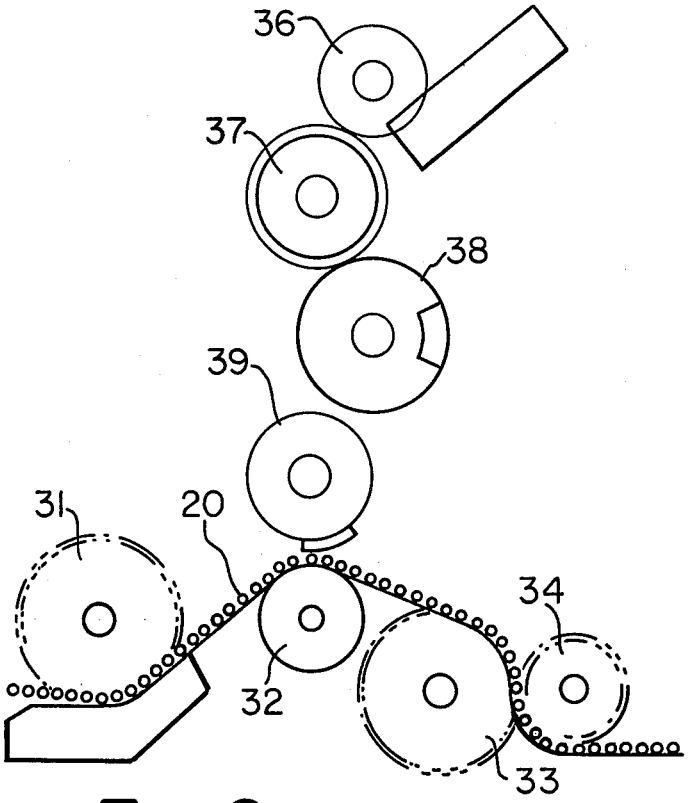

Referring now to FIG. 2, the tape 20 is fed under an idler sprocket 31 of the entry guide, over the bending roll 32 of the tape drive assembly, over the drive sprocket 33 and under the hold-down roll 34 of the tape drive assembly. When the back of the tape is caused to conform to the bending roll 32 the grip upon the axial leads of the components is loosened to permit freer rotation of the components. The ink wheels comprise a reservoir wheel 36 which passes through the ink reservoir, a transfer wheel 37 that accepts ink from the reservoir wheel to form a uniform thickness coating, an information wheel 38 which is treated to accept ink according to the indicia to be transferred to the component and the offset wheel 39 which transfers ink to the component.

The offset wheel has a larger diameter portion that carries the ink and rolls against the component. The larger diameter portion has a leading face portion that engages the component and initiates the rotation of the component before the trailing face portion carries the ink over the component. Thus the circumferential speeds of the offset wheel and the component are matched prior to printing avoiding smudging and smearing. It should be noted that the direction of travel of the tape and the circumference of the offset wheel are the same.

Figure 3:
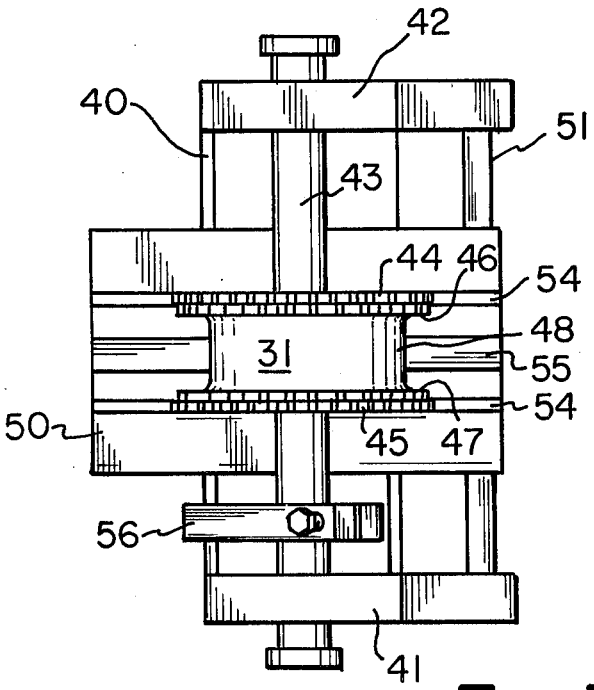
FIG. 3 is a top view of the entry strip guide.
Figure 4:
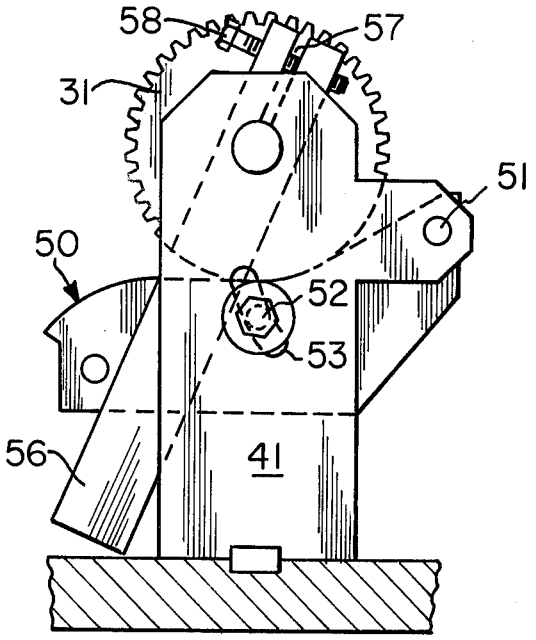
FIG. 4 is a side view thereof.

Referrring now to FIGS. 3 and 4, the entry guide 27 comprises a base plate 40 and front bearing block 41 and rear bearing block 42 secured to and rising from the base plate. A ball bearing in each bearing block 41, 42 enables the shaft 43 to be journaled in the bearing blocks. The shaft carries the idler sprocket 31. The idler sprocket has five axial sections. The two outer sections 44, 45 have teeth for engaging the sprocket receiving holes on the edge of the tape. Two sections 46, 47 just inside the outer sections have serrations for spanning (stepping over) the component leads. The center section 48 is of reduced diameter to clear the components. A tape support assembly comprises a shoe 50 is pivotally mounted by rod 51 to the bearing blocks. The shoe has longitudinal slots 54 to provide clearance for sprocket teeth passing through the openings in the tape and slots 55 for component bodys extending below the tape. The tape support assembly has a second rod 52 slidably positioned in arcuate slots 53 in the bearing supports. With thumb screws, the tape support may be fixed relative to the bearing blocks. Thus the shoe can be rotated away from the idler sprocket for feeding the tape through the entry guide and then rotating into a position holding the tape against the sprocket.

A brake 56 attached to the axle 43. The brake comprises an arm having a bore therein with a nylon bushing that surrounds the axle. There is a slot 57 in the arm that opens to the bore forming two fingers. A thumb screw 58 passes through an unthreaded bore in one finger and thence to a threaded bore in the other finger for the purpose of squeezing the two fingers together to squeeze the nylon bushing against the axle. The lower end of the arm bears against the base 40. By adjusting the thumb screw the drag upon the axle is adjusted. This enables the correct amount of back tension on the tape being pulled over the bending roll. It should be noted that sufficient back tension cannot be provided at the pay-off reel else the component tape tends to overwind on the pay-off reel (in the fashion of a coil spring). This overwinding can damage the components.

Figure 5:
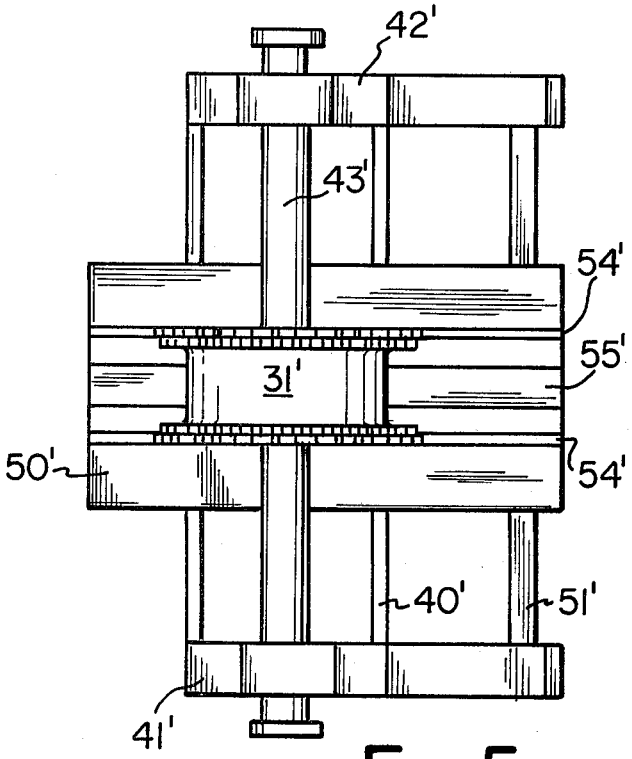
FIG. 5 is a top view of the exit strip guide.
Figure 6:
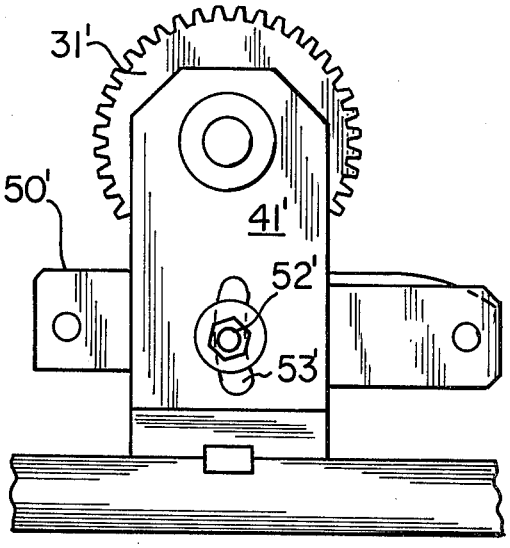
FIG. 6 is a side view thereof.

Referring to FIGS. 5 and 6, the exit guide is constructed to be almost identical to the entry guide. The corresponding elements bear the same numbers with the prime marker. The main difference is the shape and the positioning of the pivotally mounted guide strip 50'. The strip guide for the entry strip is curved to guide the tape upward whereas the exit strip guide is horizontal. With both guides, the component tape drives the sprocket wheel which in turn holds down the tape while stepping over the component leads. The exit guide has no brake.

Figure 7:
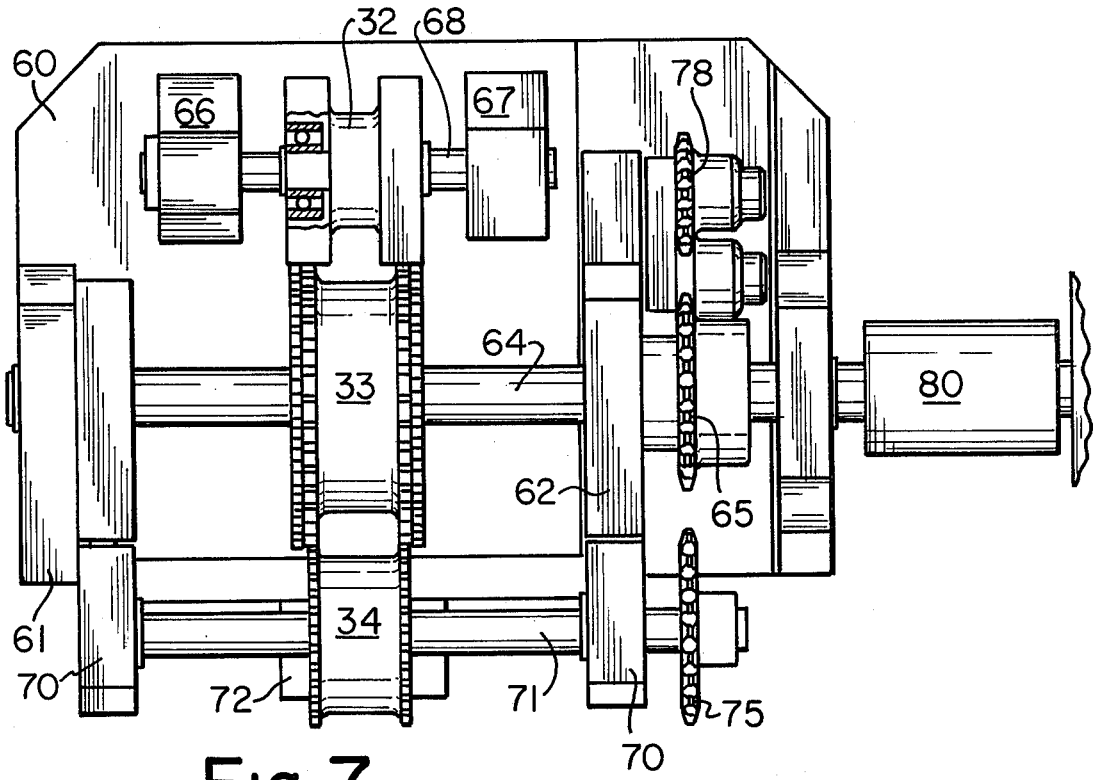
FIG. 7 is a top view of the drive assembly.
Figure 8:
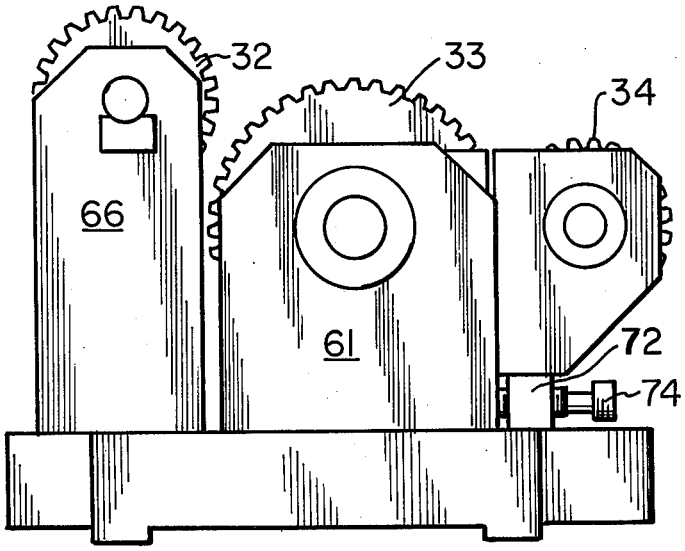
FIG. 8 is a side view thereof.
Figure 9:
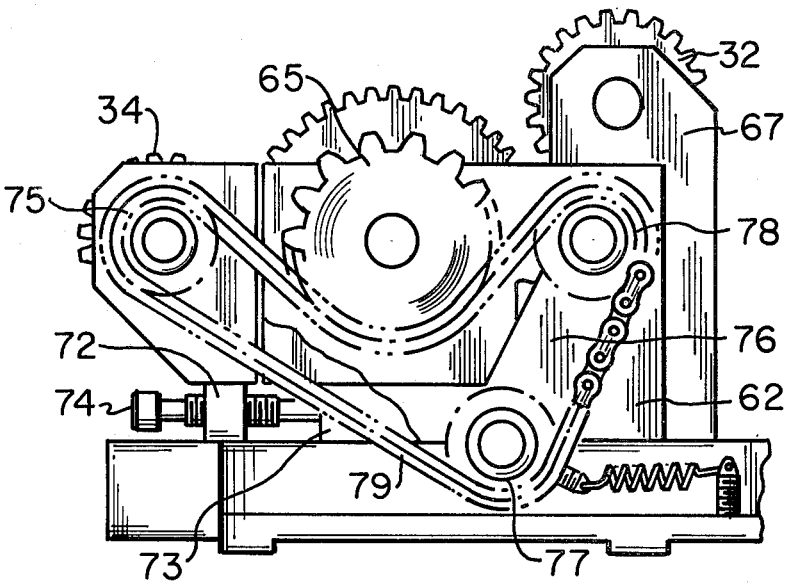
FIG. 9 is a back side view thereof.

Referring now to FIGS. 7, 8, and 9, the drive assembly comprises a base 60 with front and back bearing blocks 61 and 62 attached to and rising from the base. The bearing blocks support ball bearings for journaling a horizontal main shaft 64. Mounted upon the main shaft is drive sprocket 33. The main drive sprocket may be identical to the idler sprocket 31; however, only the outer sections need be toothed for engaging the sprocket holes. The next inner rim may have a plain cylindrical surface.

Support frames 66, 67 fixed to and rising from the base 60 carry horizontal axle 68 upon which ball bearing bending roll 32 is rotatably fixed. Main shaft 64 and axle 68 have parallel axes. There is an annular groove in the bending roll to provide clearance for the portion of the component body extending below the tape.

Slidably fixed relative to the bearing blocks 61, 62 is a front bearing housing support assembly 70 in which a front shaft 71 is journaled in ball bearing. The front shaft is parallel to the main shaft and the axle 68. The front shaft remains parallel when the support assembly moves the main shaft and front shaft together or apart. A front adjusting bar 72 rides in the slotway provided in the base 60. Fixed to the base is a back adjusting bar 73. An adjustment screw 74 is secured in the front adjusting bar 72 and secured against axial movement in the back adjusting bar 73. The adjustment screw enables the distance between the front shaft 71 and the main shaft 64 to be set. Fixed to the front shaft 71 is a hold down roll 34. The hold down roll has toothed rims. The teeth are positioned to step over the leads of the axial lead components.

The main shaft 64 carries a chain drive sprocket 65. The front shaft 71 carries a chain drive sprocket 75. Mounted to one back plate is a chain tensioner sprocket assembly which is an arm 76 pivotally mounted at one end to the bearing block and carrying a chain idler sprocket 77 on the same axis as the arm and carrying a chain idler sprocket 78 at the other end. A spring biases the chain idler sprocket 78 away from the other sprockets 65, 75. A chain 79 is positioned over chain sprockets 65, 75, 77 and 78 which causes the tape hold-down roll to be turned in the opposite angular direction to the tape drive sprocket. The chain is driven from the chain sprocket 75. The tensioner assembly permits the adjustment of the adjusting screw 74. The ratio of the teeth on the chain sprockets 65, 75 is such that the tangential speeds of the tape drive sprocket 34 and the tape hold-down roll are identical so that the hold-down roll will always step over the component leads. The power input to the tape drive assembly is directed to the main shaft 64 by a coupling 80.

The tape drive assembly 28 is driven in synchronism with the print station 24 so that the drive assembly advances one component to the offset wheel for each revolution of the offset wheel. The power for the tape drive assembly is taken directly from the output of the motor 14 and the power for the tape drive assembly 28 is taken from the gear reducer 15. A single position clutch (not shown) is provided between the gear reducer and the tape drive assembly. The clutch is essentially a coupling that only locks when the two shafts are in one angular position relative to each other. This may be achieved by having balls extending from sockets associated with one shaft that seat in sockets associated with the other shaft under coupling conditions but not under clutching conditions. Thus the tape can remain stationary while the print wheels are being adjusted but without losing the phasing between the component tape and the print wheel.

Figure 10:
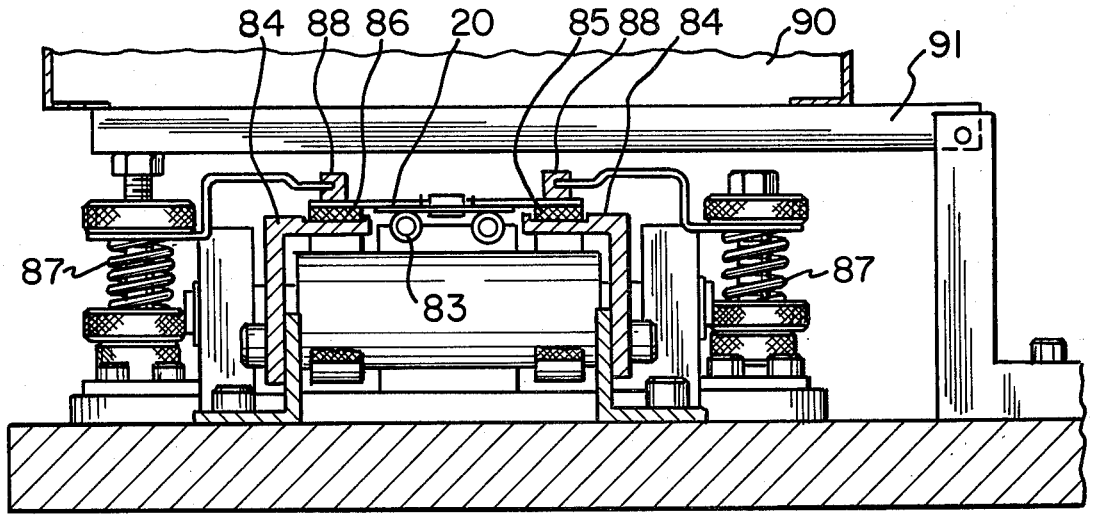
FIG. 10 is a transverse section view through the dryer.

Referring to FIGS. 1 and 10, the oven or dryer 25 has a longitudinal track 83 for supporting the component tape 20. The track provides clearance under the tape so that the portion of the components extending below the tape are not interferred with and the wet ink is not smeared. Outside the track, that is, to either side thereof, are longitudinal belt support surfaces 84. These surfaces are positioned below the extension of the axial leads of the components laterally of the component tape. Sliding over the belt support surfaces 84 and contacting the underside of the component leads are two longitudinal continuous belts 85, 86 that turn on rollers at each longitudinal end of the dryer. Springs 87 bias longitudinal rails 88 down upon the component leads just over the belts 85, 86. The component tape is pulled through the furnace by the take-up reel at a speed controlled by the tape drive sprocket. The belt in the dryer is driven so that the top surfaces of the belts bear upon the component leads and travel faster than the component tape. In this way, the components are caused to rotate as they pass through the furnace to enable the uniform drying of the components.

The dryer has a hood 90 which is hingedly supported by hinges 91 over the longitudinal track 83. The heating apparatus (not shown) for example, ultraviolet or infrared or hot air devices may be housed in the hood and directed toward the longitudinal track, that is, the upper surface of the component tape. Because the hood is hinged it may be rotated away from the track when the component tape leader is being threaded therethrough.

U.S. patent application Ser. No. 291,028 describes a specific flexible tape suitable for use according to this invention. A preferred tab configuration for use where components upon the tape are to be printed and dried with the equipment of this invention is configured with the edges of the tabs facing the slot being substantially parallel below the predefined width at the end away from the tape. This permits the rotation of the component while upon the tape with less likelihood of scoring the leads.

OPERATION

The overall system according to this invention which has actually been reduced to practice takes axial lead components which are mounted on a stainless steel tape of the like and processes them through a printing and drying operation. Typical axial lead components can be magnetic or nonmagnetic. Various sizes of resistors, capacitors, and diodes can be processed through this machine. The machine may operate at speeds of 6,000 to 14,000 parts per hour depending upon the components and the type of operation selected.

A leader (component tape with no parts) of about six to seven feet long is manually pulled off the pay-off reel 18. It is manually introduced into the entry guide 27 and between the offset wheel 39 and the bending roll 32. The power is turned on so that the tape drive sprocket 33 starts to move. The metal strip is placed between the strip drive sprocket and the idler sprocket so that cutouts in the strip are aligned with the teeth on the drive sprocket. With the machine running the leader is paid through the oven 25 and through the exit guide 29 and on to the take-up reel 21. This completes the set-up.

A synchronized system of components moves continuously past the printer where they are marked by the rubber offset wheel 39. Ink thickness is controlled by adjustments at the reservoir. The information wheel is extraordinarily precise having separate images centered exactly to achieve accurate registration of markings during printing.

Parts are carried continuously through the printer by the component tape. As a component passes under the offset wheel a spin is imparted to the component proportional to the offset wheel velocity. The information to be transferred is located on the offset wheel just before it loses contact with the component. This prevents any smearing of the printed surface.

To set up the printer station, a small quantity of ink is placed on top of the reservoir wheel, an adjusting screw is turned to control a blade over the wheel until the steel of the wheel begins to show through the ink. An ink film of from two to four mills on the reservoir wheel is ideal for clear, sharp printing. The ink transfer wheel is adjusted to the ink reservoir wheel to achieve a smooth, even film of ink on the ink transfer wheel. Normally $\frac{1}{8}$ inch of contact between the two wheels is sufficient pressure. The information wheel may be horizontally adjusted. Note that it is extremely important for good quality print to have the proper adjustment between the information wheel and the transfer wheel. Excessive pressure between the type and the transfer wheel can result in printing "hollow" characters. The ideal condition is achieved when the type penetrates into the ink film without touching the rubber.

The offset wheel is adjusted to the information wheel so that the type bearing touches the rubber. The information wheel must be timed with the conveyor so that the print is centered on the component. If it is off centered to the left, the collar on the shaft is loosened and turned and the whole wheel is turned clockways to compensate. Once this adjustment is made, the wheel can be snapped in and out by the one position clutch without losing any adjustment.

The entire print station is mounted to be raised and lowered relative to the tape drive to achieve the correct amount of pressure on the component by the offset wheel. Because the bending roll supports the tape to each side of the component opening and the axial leads bear upon the thus supported portion of the tape, the leads are not bent under the pressure required for proper printing.

Having thus described the invention with the details and particularity required by the Patent Laws, what is desired protected by Letters Patent is set forth in the following claims.

We claim:

1. An apparatus for printing upon the body of axial lead components arranged upon a component tape, the tape having equally spaced openings for receiving sprocket teeth and equally spaced component receiving openings, there being tabs associated with said component openings extending from the tape defining slots being narrowed at the end away from the tape which slots may be spread by bending the tape comprising a horizontal base, a print station fixed above the base having at least an offset wheel rotating on a horizontal axis for rolling over the surface of the components to be printed to transfer indicia thereto, a bending roll mounted on an axle substantially parallel to the horizontal base, said roll having a circumferential groove therein so that the loaded component tape can be drawn over the bending roll without interference with the components, the diameter of the bending roll being sufficiently small to bend the tape enough to spread slots in the tabs thereof and to present only one component to the offset wheel of the print station at a time, an entry guide for slidably holding the loaded tape below the top of the bending roll, an exit guide for slidably holding the loaded tape below the top of the bending roll and having a sprocket wheel for engaging the sprocket openings in the tape and pulling the tape over the bending roll.

2. The apparatus according to claim 1 further comprising means or driving the offset wheel and sprocket wheel in synchronism such that the tape advances one component per revolution of the offset reel.

3. The apparatus according to claim 2 wherein the driving means includes a single position clutch for engaging and disengaging the power to the sprocket wheel.

4. Apparatus according to claim 2 wherein the trailing edge of the offset wheel carries the indicia to be printed on the component body such that the component is set in rotation prior to the printing.

5. An apparatus according to claim 1 wherein the entry guide comprises an idler sprocket fixed to a shaft, said idler sprocket having teeth for engaging the sprocket openings on the tape, means for guiding the tape to maintain engagement of the sprocket teeth with the tape and an adjustable brake on the shaft to resist the rotation of the shaft and place a drag upon the tape.

6. An apparatus according to claim 5 wherein the holding means comprises a shoe having longitudinal slots to provide clearance for the components extending down through the tape and to provide clearance for the sprocket teeth extending down through the tape such that the shoe is placed in sliding engagment with the bottom of the tape.

7. The apparatus according to claim 1 wherein the exit guide comprises a driving roll having spaced drive sprockets for engaging the sprocket holes in the tape and a presser roll for pressing the tape against the driving roll.

8. The apparatus according to claim 7 wherein the presser roll has a central portion of reduced diameter for clearing the component bodies and tabs and two cylindrical ribs having radial grooves therein for clearing component leads.

9. An apparatus according to claim 8 wherein the driving roll and the presser roll are driven in different angular directions in synchronism to cause the ribs of the presser to step over the leads of the components on the tape.

10. Apparatus according to claim 8 wherein the axial distance between the ribs on the presser roll is just less than the distance between the drive sprocket on the driving roll and greater than the distance between the tabs.

11. The apparatus according to claim 7 wherein the driving roll is positioned for the loaded tape to pass thereover and has a diameter large enough to prevent the tabs from spreading and releasing the component leads.

12. An apparatus according to claim 1 further including a dryer comprising a longitudinal track over which the tape slides, a pair of longitudinal belts support surfaces positioned to each side of the track, a pair of continuous belts moving over the belt support surfaces in contact with the leads of the components on said tape, a pair of longitudinal rails positioned over the belts and spring biased to press the component leads down against the belts, means to drive the belts at a different speed than the tape to cause the components to rotate upon the tape, an insulated hood for positioning over the track and means for warming the components on the tape as it passes under the hood.

* * * * *